US008104218B2

(12) United States Patent
McCann

(10) Patent No.: US 8,104,218 B2
(45) Date of Patent: Jan. 31, 2012

(54) FIREARM ACCESSORY RAIL WITH INTEGRAL SIGHT ELEMENTS

(76) Inventor: Richard J. McCann, Spanaway, WA (US)

( * ) Notice: Subject to any disclaimer, the term of this patent is extended or adjusted under 35 U.S.C. 154(b) by 73 days.

(21) Appl. No.: 12/704,843

(22) Filed: Feb. 12, 2010

(65) Prior Publication Data

US 2011/0197491 A1 Aug. 18, 2011

(51) Int. Cl.
*F41G 1/00* (2006.01)

(52) U.S. Cl. ..... 42/144; 42/111; 42/112; 42/72; 42/113

(58) Field of Classification Search ..... 42/112, 42/133, 139, 132, 144, 145, 72, 111, 113
See application file for complete search history.

(56) References Cited

U.S. PATENT DOCUMENTS

| | | | | |
|---|---|---|---|---|
| 3,732,642 | A | 5/1973 | Bray | |
| 4,574,335 | A | 3/1986 | Frimer | |
| 4,691,442 | A | 9/1987 | Center | |
| 4,713,889 | A | 12/1987 | Santiago | |
| 5,070,619 | A | 12/1991 | Santiago | |
| 5,134,798 | A | 8/1992 | Lee | |
| 5,533,292 | A | 7/1996 | Swan | |
| 5,606,818 | A | 3/1997 | Hardee | |
| 5,735,070 | A * | 4/1998 | Vasquez et al. | 42/1.02 |
| 5,966,825 | A | 10/1999 | Biemont | |
| 6,508,027 | B1 | 1/2003 | Kim | |
| 6,606,813 | B1 | 8/2003 | Squire et al. | |
| 6,732,467 | B1 | 5/2004 | Luth | |
| 6,779,288 | B1 | 8/2004 | Kim | |
| 6,779,290 | B1 | 8/2004 | Houtsma | |
| 6,854,206 | B2 | 2/2005 | Oz | |
| 6,886,289 | B1 | 5/2005 | Rigler | |
| 6,895,708 | B2 | 5/2005 | Kim et al. | |
| RE39,465 | E | 1/2007 | Swan | |
| 7,216,451 | B1 | 5/2007 | Troy | |
| 7,363,741 | B2 | 4/2008 | DeSomma et al. | |
| 7,367,152 | B2 | 5/2008 | Samson | |
| 7,627,976 | B1 * | 12/2009 | Olson | 42/145 |
| 7,685,758 | B2 | 3/2010 | Romer | |
| 7,743,547 | B2 | 6/2010 | Houde-Walter | |
| 2003/0140546 | A1 | 7/2003 | Kay | |
| 2004/0000083 | A1 | 1/2004 | Grant, Jr. | |

(Continued)

OTHER PUBLICATIONS

Mesa Tactical Catalog No. 12; Mar. 1, 2009.

*Primary Examiner* — Michael Carone
*Assistant Examiner* — Daniel Troy
(74) *Attorney, Agent, or Firm* — Wood, Herron & Evans, LLP

(57) ABSTRACT

A firearm accessory mounting rail with an integrated back up sight system including an elongated Picatinny rail having longitudinally spaced apart first and second end regions and a transverse profile. A first sight element has a visual marker substantially centrally positioned. A second sight element has laterally spaced apart visual markers. A substantially centered longitudinal channel extends along the upper surface of the rail between the first and second sight elements. The firearm may be sighted by visually aligning the marker of the first sight element between the markers of the second sight element, the visual alignment being at least partially through the longitudinal channel. The sight elements may be defined completely within the transverse profile of the rail so as not to interfere with the normal attachment of any accessories to the rail and may be adjustable for windage and/or elevation. The visual markers may be illuminated by light gathering fiber optic or tritium elements.

13 Claims, 6 Drawing Sheets

U.S. PATENT DOCUMENTS

| | | | |
|---|---|---|---|
| 2005/0011104 | A1 | 1/2005 | Oz |
| 2005/0217161 | A1 | 10/2005 | Haugen et al. |
| 2005/0241211 | A1 | 11/2005 | Swan |
| 2005/0268519 | A1 | 12/2005 | Pikielny |
| 2006/0075674 | A1 | 4/2006 | Ding |
| 2008/0092423 | A1 | 4/2008 | Keng |
| 2008/0216380 | A1 | 9/2008 | Teetzel |
| 2010/0037505 | A1 * | 2/2010 | Romer ..... 42/124 |

* cited by examiner

Fig. 4
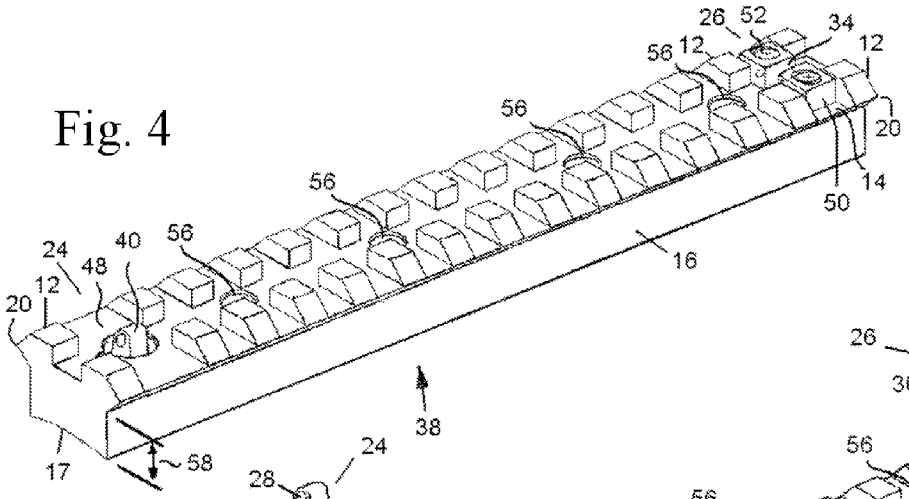
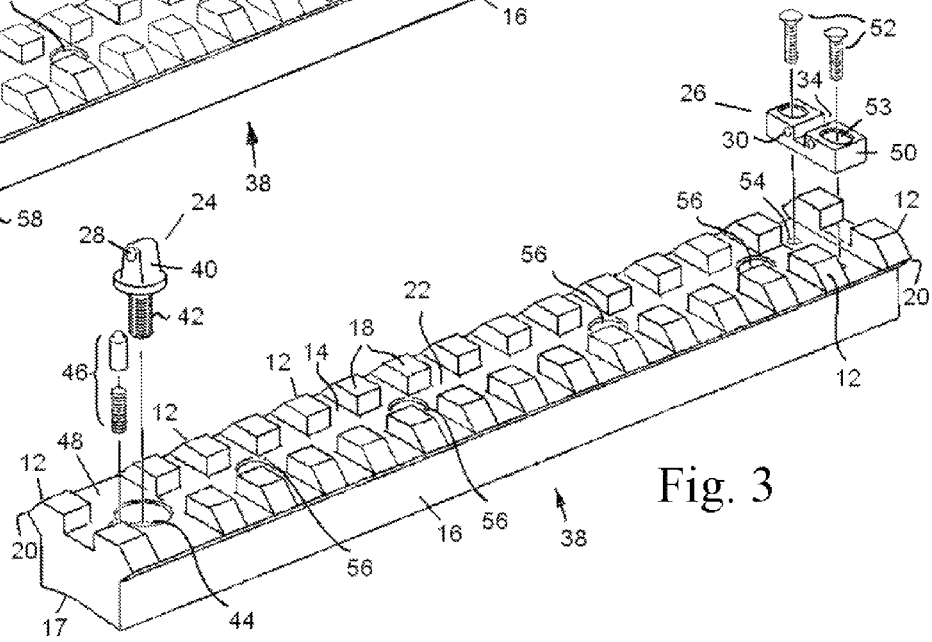
Fig. 3

FIREARM ACCESSORY RAIL WITH INTEGRAL SIGHT ELEMENTS

TECHNICAL FIELD

The present invention relates to a rail for mounting optics or other accessories to a firearm, the mounting rail having integral sighting elements. More specifically, it relates to the integration of back-up or "iron" sights into a mounting rail in a manner that does not interfere with the mounting of accessories.

BACKGROUND

Standardized accessory mounting rails are well known for use with firearms. Most common is the Picatinny, Weaver, or MIL-STD 1913 rail, referred to herein collectively or interchangeably as a "Picatinny" rail or mounting rail. A Picatinny rail can range in length from less than one inch, such as for mounting a light or laser indicator to the underside of a pistol frame or for mounting a single scope ring, to the full length of a rifle. Typically, these standardized accessory attachment rails are formed or secured along the length of the frame, stock, or barrel parallel to the bore of the firearm barrel so that any sighting device, scope, or light is substantially aligned with the barrel either at the top, bottom, or side of the firearm.

In some cases, "open" or "iron" sights (sights that do not include any lens or projected beam of light) must be removed or rendered unusable in order to mount an accessory rail. In other cases, the firearm (such as a bolt action rifle) may not have any open sights and sighting is dependent on use of a rail-mounted telescopic or holographic sighting system or the addition of upstanding (or flip-up) iron sight elements. For some users, the consequences of a scope or lighted sight system failure are too great not to have some kind of pre-aligned back up iron sights (BUIS) in place in addition to whatever optics are mounted on the accessory rail.

Separate front and/or rear (fixed or flip-up) iron sights can be rail mounted along with a scope or holographic sight in some cases. These, however, add complexity, cost, weight and bulk to the weapon system. Some of these shortcomings are discussed in U.S. Patent Application Publication No. 2008/0092423 by Keng.

As another example, a shotgun may be used for hunting with a rail-mounted scope, but may also be used for home defense where a magnifying scope is undesired. Removal of the scope leaves it without any sights unless separate iron sights are installed in its place. Shotguns are also used in military and civilian law enforcement tactics where a need for back up iron sights along with a rail mounted optical sight is present. This need is discussed in U.S. Patent Application Publication No. 2003/0140546 by Kay. In Kay, an elevated rear sight element is integrated with a Picatinny mounting rail. This system raises the sight line a significant distance above the bore axis and requires the addition of a separate, M16-style elevated front sight to the forward end of the barrel.

Consideration of the Keng and Kay Patent Application Publications will provide context for and reveal the significance of the present invention.

SUMMARY OF THE INVENTION

The present invention provides a firearm accessory mounting rail with an integrated back up sight system. It includes an elongated Picatinny rail with longitudinally spaced apart first and second end regions and a transverse profile. A first sight element has a visual marker substantially centered laterally. A second sight element has laterally spaced apart visual markers. A substantially centered longitudinal channel extends along an upper surface of the rail between the first and second sight elements. The firearm may be sighted by visually aligning the marker of the first sight element between the markers of the second sight element, the visual alignment being at least partially through the longitudinal channel.

The sight elements may be defined completely within the transverse profile of the rail so as not to interfere with the normal attachment of any accessories to the rail and may be adjustable for windage and/or elevation. The visual markers may be distinctly colored or illuminated by light gathering fiber optic or tritium vial elements. The second sight element can be in the form of an aperture.

BRIEF DESCRIPTION OF THE DRAWING

Like reference numerals are used to indicate like parts throughout the various figures of the drawing, wherein:

FIG. 3 is a front isometric exploded view of a second preferred embodiment of the invention;

FIG. 4 is an assembled view substantially like that shown in FIG. 3;

DETAILED DESCRIPTION OF THE INVENTION

Figure 1:
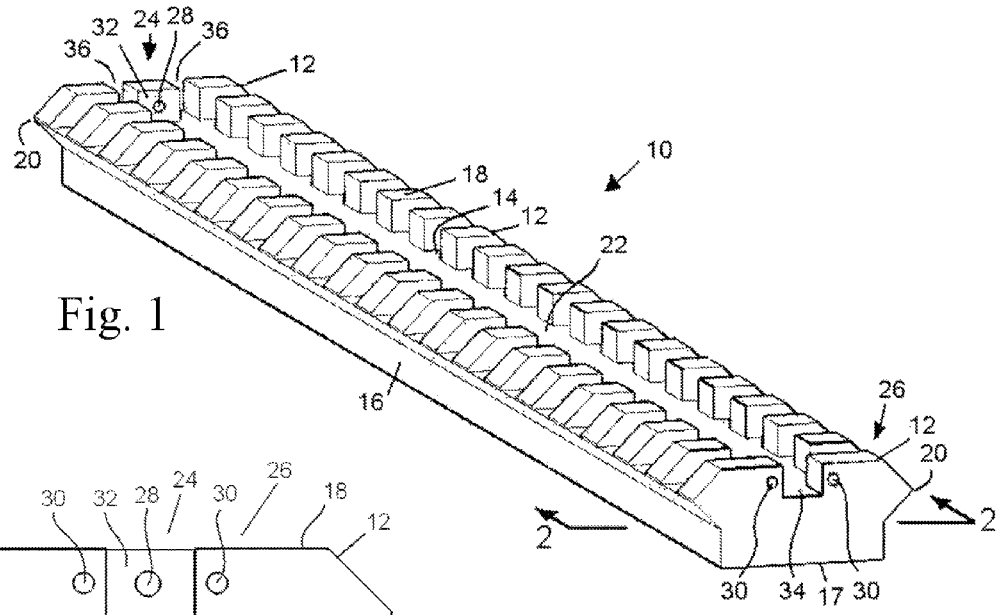
FIG. 1 is a rear isometric view of a first preferred embodiment of the present invention.

Referring to the various figures of the drawings and first to FIG. 1, therein is shown at 10 an accessory mounting rail with an integrated back up sight according to a first preferred embodiment of the present invention. The rail 10 is an elongated member having a series of laterally-extended lugs 12 with spacing slots 14 there-between. The lugs 12 are supported by a base portion 16 and present a dovetail or chamfered T-shaped profile in cross section. The base 16 may be independent or integrated into a firearm receiver, barrel shroud, stock or other implement. If the rail 10 is a separate fixture and is to be to be secured in place on a firearm, the base 16 may be shaped to engage any desired surface. For example, the bottom surface 17 may be flat or curved to fit closely and firmly onto a corresponding surface. The lugs 12 provide coplanar top surfaces 18 which present a platform on which accessories (not shown), such as an optic device, scope rings, or illumination device may be situated.

An accessory is mounted either by sliding it on from one end or by means of a "rail grabber," which engages the laterally opposite dovetail edges 20 of each lug 12 and is clamped to the rail 10 with bolts, thumbscrews, or levers, or onto the slots 14 between the raised lug portions 12. The transverse slots 14 allow a fastening member to extend transverse of the mount 10 for releasably gripping the dovetail edges 20. In this regard, the rail 10 provides a standardized accessory mounting device commonly referred to as a Picatinny, Weaver, or MIL-STD 1913 rail. As used herein, each of these are referred to collectively or interchangeably as a "Picatinny" rail or "standardized" accessory mounting rail, as the differences between these versions is not important to the present invention.

A top platform surface 18 extending the complete width of the lug 12 is not required in order to securely mount accessories to a Picatinny rail. In order to reduce the overall weight, it is well known in the art to provide a longitudinal trough or channel 22 along its length. An example of a standard Picatinny rail without a longitudinal channel is shown in the aforementioned Keng Patent Appl. Pub. No. 2008/0092423. An example of a Picatinny rail which includes a longitudinal central channel is shown, for example, in U.S. Pat. No. 6,508,027.

According to one aspect of the present invention, longitudinally spaced apart sight elements 24, 26 are integrated into the rail 10. The first sight element 24 includes a visual marker 28 which is positioned substantially centrally of the lateral width of the rail 10. In preferred form, the first sight element 24 is at or near a forward end region of the rail 10. The second sight element 26 includes a pair of laterally spaced apart visual markers 30. Also in preferred form, the second sight element 26 is located at or near an opposite or rearward end region of the rail 10.

In simplest form, the forward or first sight element 24 may comprise a simple upstanding post that is entirely confined within the profile of the forward most lug 12 and laterally centered within the channel 22. The rearward facing surface 32 may be sufficient to provide a visual marker for the forward sight element 24, or a spot 28 of contrasting color may be applied or formed thereon. Alternatively, the visual marker spot 28 may include a fiber optic insert or tritium vial to provide enhanced visibility. As can be seen in FIG. 1, the forward sight element 24 of this embodiment allows completely unencumbered use of the rail 10 for mounting purposes.

Also in simplest form, at the opposite or rearward end of the rail 10 the second sight element 26 may be formed completely within the profile of the rearward most lug 12. In a simple form, the second sight element 26 may be a substantially centered notch 34 such that visual markers are formed by the remaining structure on either side. Visibility may be enhanced by visual marker spots 30. These markers 30, like the forward visual marker 28, may be a contrasting color or may include a light-gathering fiber optic insert or light-emitting tritium vial.

Figure 2:
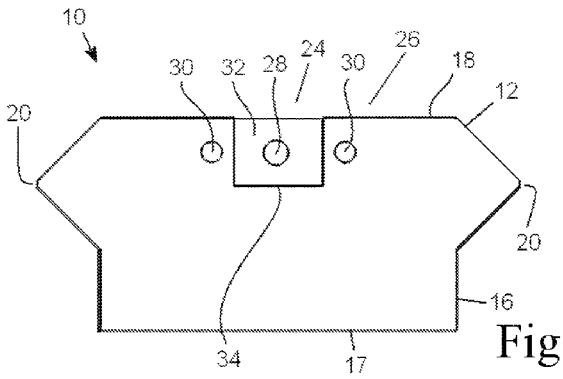
FIG. 2 is a rear end view substantially as indicated by line 2-2 on FIG. 1.

Referring now also to FIG. 2, it can be seen that alignment of the visual marker 28 of the forward sight element 24 between visual markers 30 of the rear sight element 26 provides a familiar "post and notch" sight image.

The notch 34 between rear sight element 26 visual markers 30 may be of a width similar to that of the longitudinal channel 22, or may be wider or narrower, as desired. Likewise, the width of the forward element 24 can be equal to the width of the notch 34, or may be more narrow, if desired. In preferred form, the width of the forward element 24 is no greater than the width of the notch 34. Providing spaces 36 on each side of the forward element 24 provides a contrasting visual appearance and facilitates quick visual alignment of the forward and rear sight elements 24, 26. However, simply providing a visual marker spot 28 on the rearward face 32 and maintaining the forward most lug uninterrupted along its full width could provide a functional, though less desirable, forward sight element 24.

Referring now to FIGS. 3 and 4, therein is shown at 38 a standardized accessory mounting rail with integral back-up sights according to an alternate embodiment. This embodiment illustrates how adjustable forward and rear sight elements 24, 26 may be incorporated to allow elevation and windage adjustment.

A forward sight element 24 may be made adjustable by using a threaded sight post 40, like that commonly found in the front sight of an M16 or similar style rifle, for example. An adjustable post 40 includes a threaded portion 42 threadingly received into a socket 44 laterally centered in the longitudinal channel 22. As is well known, the post 40 may be adjusted in height by incremental rotation. A spring detent 46 is also a well known means for holding the adjustable post 40 in place, while allowing ease of adjustment. The adjustable post 40 may include any of a wide variety of well-known visual markers 28 presented on one or both faces of the post 40.

Longitudinally, the adjustable post 40 may be positioned between opposite side portions of the forward most lug 12, in a space 14 between adjacent lugs 12, or a longitudinally enlarged space 48 may be provided. Interruption of the spacing between lugs 12 at the forward most end of the rail 38 is not considered to be a significant detraction from its utility as a standardized mounting rail. In an application where a scope ring or attachment of an accessory is likely to be positioned near the forward end of the rail 38, the rail 38 may simply be extended as necessary to accommodate placement of the adjustable post 40 of the forward sight element 24.

Referring still to FIGS. 3 and 4, a rear sight element 26 that is laterally adjustable for windage or precision aiming adjustment may be provided. In the illustrated embodiment, the rear sight element 26 includes a laterally adjustable member 50 that is mounted to the base 16 by way of one or more set screws 52. Set screws 52 pass through laterally elongated openings 53 of the member 50 and engage threaded openings 54 in the base 16. Adjustable member 50 includes a central notch 34 and may include a pair of visual markers 30 on forward and/or rear (not shown) surfaces of the member 50. By loosening set screws 52, the member 50, along with the central notch 34 and visual markers 30, may be shifted in a lateral direction and then secured in place by tightening the set screws 52. Alternatively, a lateral dovetail-type engagement (not shown) may be used.

The member 50 of the adjustable sight element 26 may be longitudinally positioned in a space 14 between adjacent lugs 12 or may be provided in place of one or more of the lugs 12.

Generally, in order to maximize the sight radius between forward and rear sight elements 24, 26, the elements will be placed at or near opposite ends of the rail 10, 38. In some applications, however, there may be a reason to situate one or both of the sight elements 24, 26 such that one or more of the lugs 12 providing functional attachment regions of the rail 10, 38 extend beyond the location of the sight element 24, 26.

Figure 5:
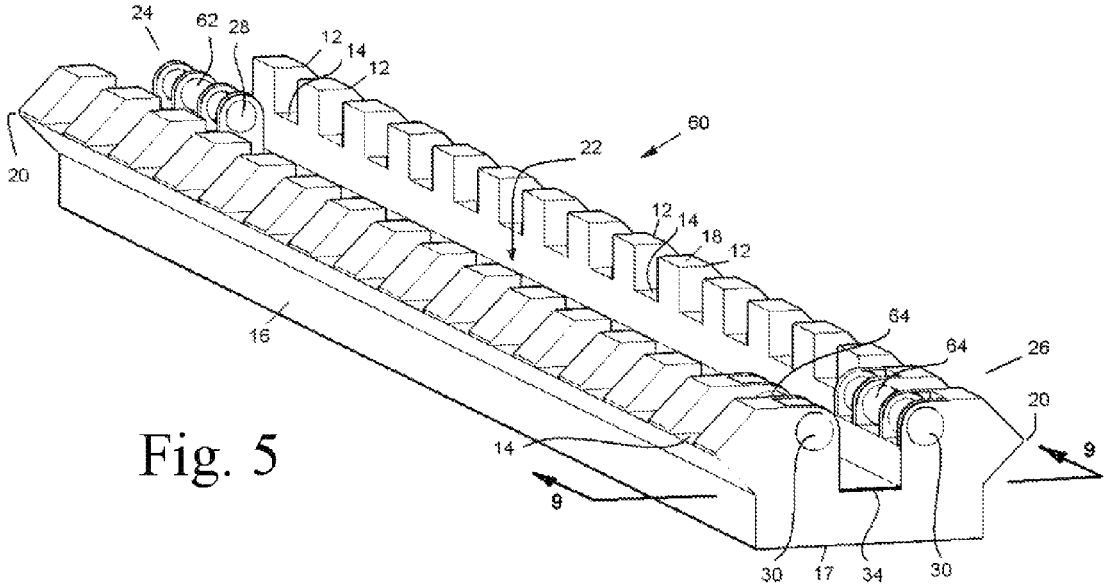
FIG. 5 is a rear isometric view of a third preferred embodiment of the invention showing the inclusion of fiber optic sight elements.
Figure 6:
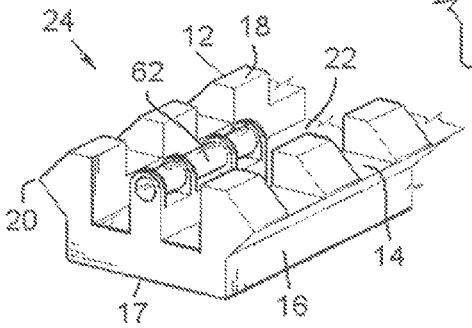
FIG. 6 is a detail front isometric view of the front sight element of the embodiment shown in FIG. 5.

Referring now to FIGS. 5 and 6, therein shown at 60 another alternate embodiment of a standardized accessory mounting rail with integrated back-up sights. In this embodiment, the forward and rear sight elements 24, 26 include light-gathering enhancements. Here the visual markers 28, 30 are end faces of light-gathering fiber optic rods 62, 64. The rods 62, 64 may be made in a well-known manner of translucent material. The fiber optic rod 62 of the forward sight element 24 may be of a color contrasting with that of the fiber optic rods 64 of the rear sight element 26. For example, the front visual marker 28 may be red and rear visual markers 30 may be green.

Figure 9:
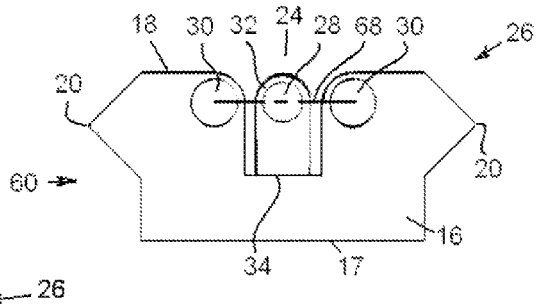
FIG. 9 is a rear view of the aligned sight elements taken substantially along line 9-9 on FIGS. 5 and 7.

In the illustrated embodiment, the fiber optic rods 62, 64 extend longitudinally the span of two transverse lugs 12 and the space 14 there-between. In this embodiment, functionality of the forward most and rearward most slots 14 is lost for purposes of an accessory connection (not shown) passing therethrough. However, the forward and rearward sight elements 24, 26 are defined and housed completely within the cross-sectional profile of the attachment lugs 12. This feature is best seen in FIG. 9. The lateral position of the rear fiber optic rods 64 can be in line with or outboard of the central channel 22

Also shown in this embodiment 60, the central longitudinal channel 22 may be formed at a depth greater than that of the transverse slots 14 between lugs 12. Also, the notch 34 between visual markers 30 of the rear sight element 26, may be more narrow than that of the longitudinal channel 22. This differential is not required and may be adjusted as desired to meet the needs of any particular application.

Figure 7:
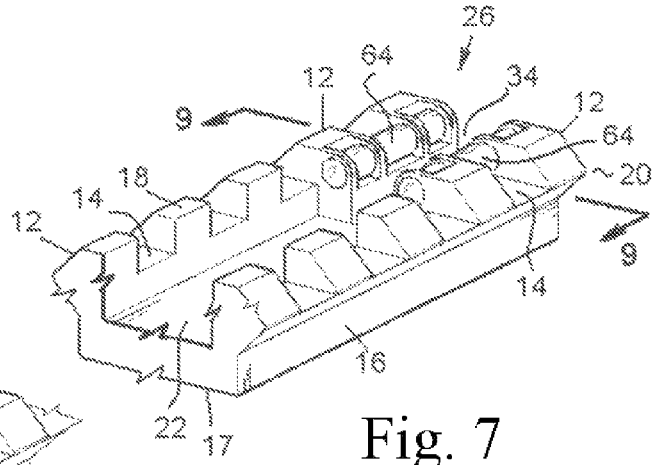
FIG. 7 is a detail front isometric view of the rear sight element of the embodiment shown in FIG. 5.
Figure 8:
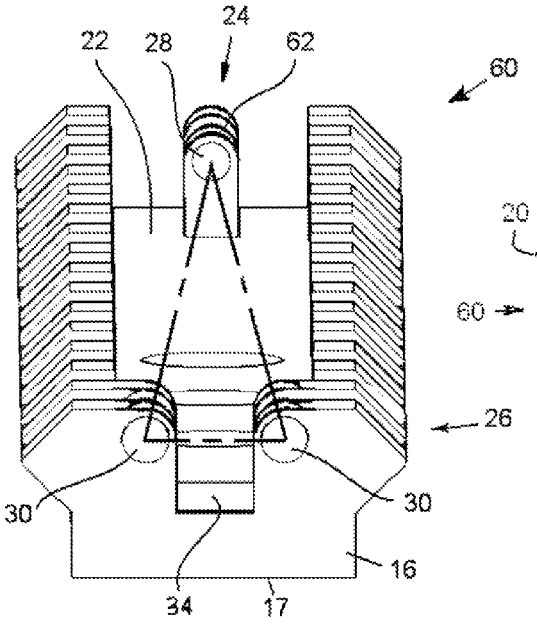
FIG. 8 is a rear parallel projection view of the embodiment shown in FIG. 5 as the sight elements are being moved into alignment.

Referring now in particular to FIGS. 8 and 9, therein is shown a mounting rail 60 like that previously described in FIGS. 5-7. FIG. 8 illustrates the manner in which the sight picture emerges as the rail 60 mounted on a firearm is brought upward into the user's field of view. When, for example, the forward sight element 24 is situated above the rear sight element 26, a visual triangle 66 is presented. If the forward sight element 24 is not correctly aligned between the visual markers 30 of the rear sight element 26, this misalignment will be reflected in the visual triangle 66 as well.

As the visual marker 28 of the forward sight element 24 becomes properly aligned both horizontally and vertically between the visual markers 30 of the rear sight element 26, the sight pattern shown in FIG. 9 is created. When properly aligned, the forward visual marker 28 is centered between the rear visual markers 30 and a straight horizontal line 68.

Figure 10:
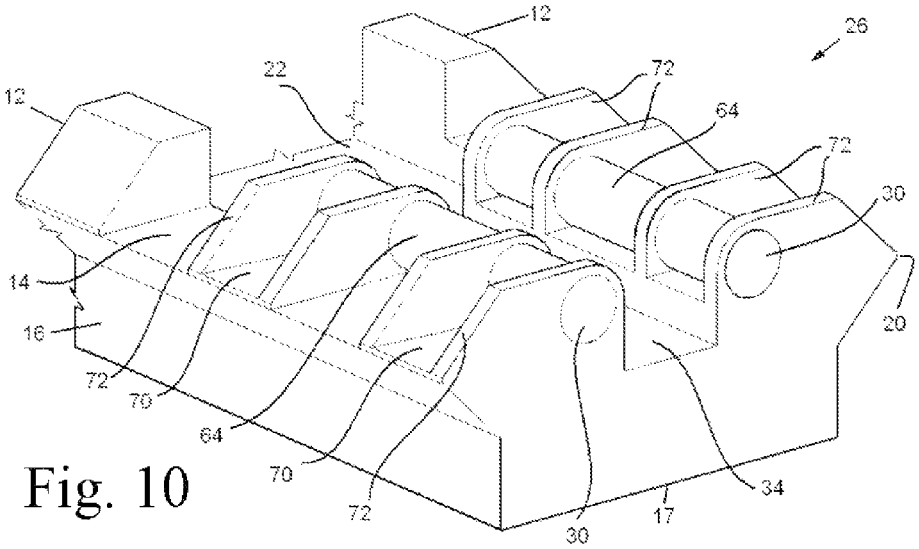
FIG. 10 is a detail rear isometric view of an alternate version of the rear sight element shown in FIGS. 5, 7, and 8.
Figure 11:
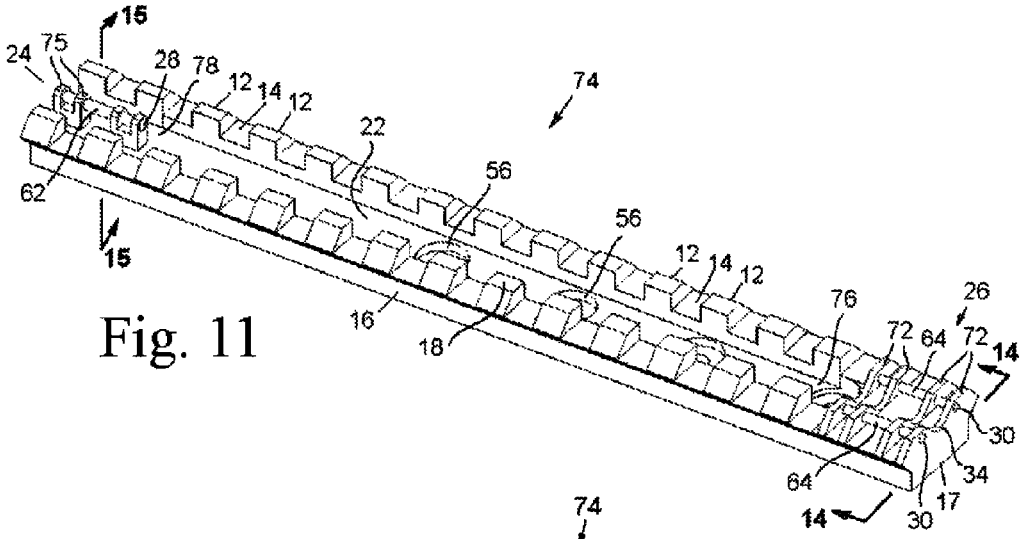
FIG. 11 is a rear pictorial view of a fourth preferred embodiment of the present invention.
Figure 12:
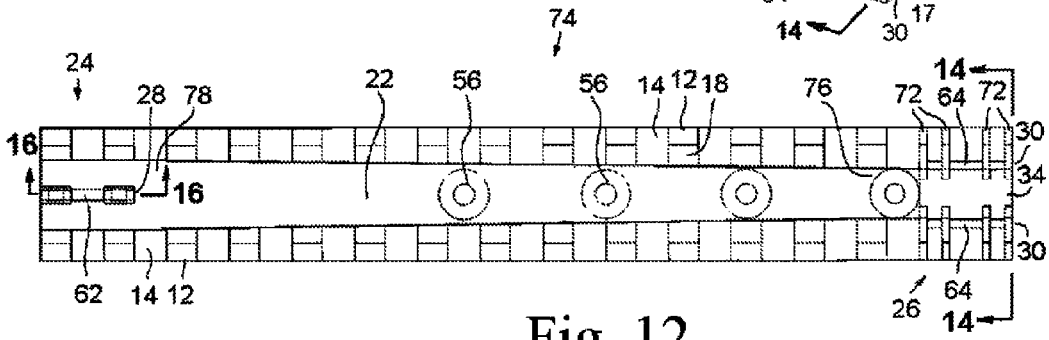
FIG. 12 is a top plan view thereof.

FIG. 10 shows an alternate embodiment of a rear sight element 26. In this example, enlarged laterally-extending openings or channels 70 are formed through the structure supporting the fiber optic rods 64. In this manner, a greater surface area of the fiber optic rods 64 is exposed to better facilitate their light-gathering ability. Also in this embodiment, the depth of the channel 22 and rear notch 34 are shown to be greater than that of the embodiments shown in FIGS. 1-4 and lesser than that shown in the embodiment of FIGS. 5-9.

The supporting members 72 are relatively thin, but in combination provide adequate strength and protection of the fiber optic rods 64 without extending beyond the transverse profile of the mounting lugs 12.

Referring now to FIGS. 11-14, therein is shown at 74 another preferred embodiment of the present invention. This embodiment 74 includes light-gathering fiber optic rods 62, 64 which function and are mounted like those previously described. Different, however, is that the width of the longitudinal channel 22 is tapered from a more narrow rearward end 76 toward a wider forward end 78. This tapering of the channel 22, which does not in any way effect the ability to mount accessories securely to the rail 74, facilitates the user's more rapidly acquiring and adjusting a proper sight picture.

Figure 13:
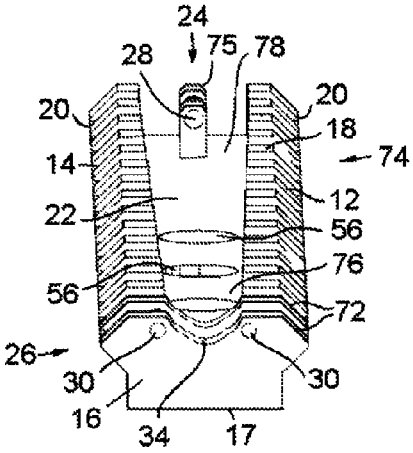
FIG. 13 is a rear parallel projection view of the embodiment shown in FIG. 11 as the sight elements are being moved into alignment.
Figure 14:
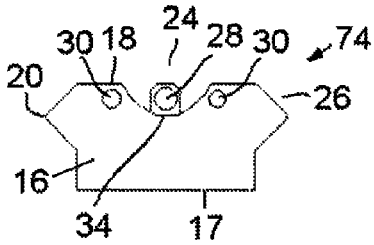
FIG. 14 is a rear view of the aligned sight elements taken substantially along line 14-14 on FIGS. 11 and 12.

Best shown in FIG. 13, the tapered-width channel 22 allows the user to more quickly find the visual marker 28 of the forward sight element 24 as the rail 74 is brought into the user's field of view. As the visual markers 28, 30 are brought into alignment, the sight picture shown in 14 is presented. The depth of the channel 22 may also be tapered (not shown), if desired. In the embodiment illustrated in FIGS. 11-14, the depth of the channel 22 does not vary, but is of a greater depth than the notch 34 of the rear sight element 26. In this manner, the ability to rapidly acquire and adjust a proper sight picture is enhanced both vertically as well as horizontally.

Figure 15:
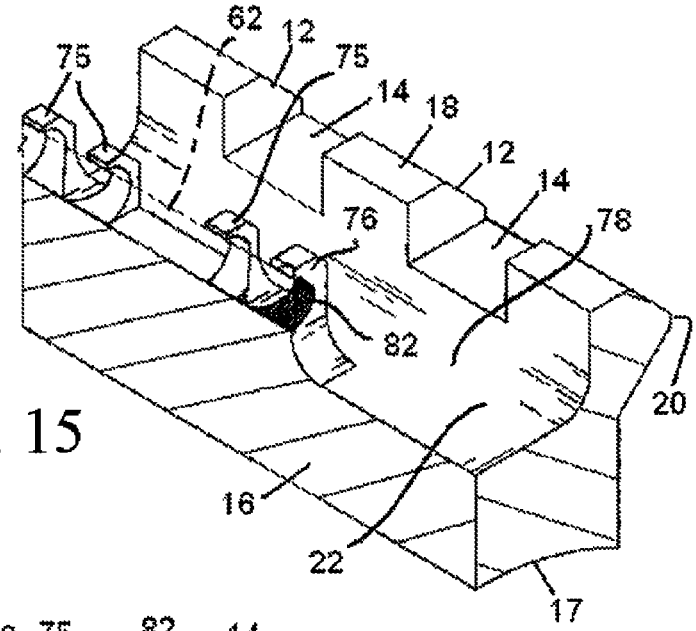
FIG. 15 is a sectional partial isometric view taken substantially along line 15-15 of FIG. 11.
Figure 16:
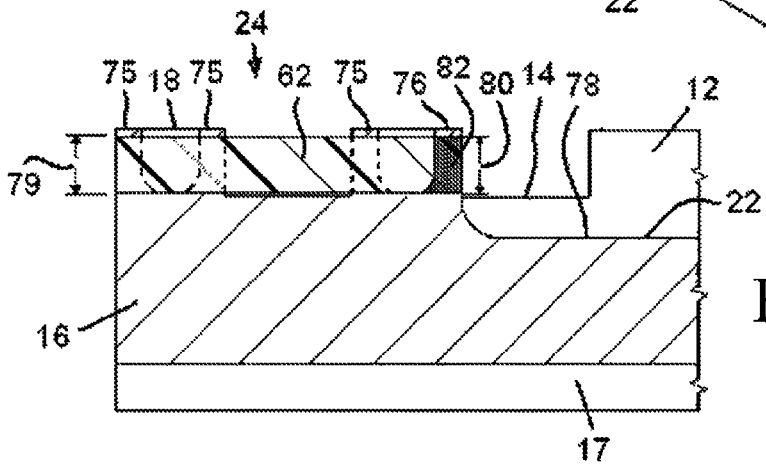
FIG. 16 is a partial longitudinal view of that shown in FIG. 15.

Referring now particularly to FIGS. 15 and 16, therein is shown a detail of a fiber optic sight element 62 and mounting structure in longitudinal section. The fiber optic rod 62 is supported by a series of members 75 which may, for example, be substantially aligned laterally and longitudinally with mounting lugs 12. The rod 62 may be held in place by any known method. In the illustrated example, a substantially cylindrical fiber optic rod 62 is longitudinally inserted through a series of longitudinally aligned bores in the support members 75. In the illustrated example, the openings of the outer support members 75 are smooth and substantially match the diameter of a selected fiber optic rod 62. In order to secure the rod 62 without the use of adhesives, the innermost support 76 may be provided with an opening of slightly reduced diameter and shallow threads that grip the outer cylindrical surface of the rod 62. The diameter 79 of the openings in the outermost support members 75 may be, for example, 0.098 inches. The opening diameter 80 of the innermost support member 76 may be, for example, 0.089 inches and threaded with a #4×40 tap. The fiber optic rod 62 material may be manufactured or pre-cut to the finished length prior to installation. Alternatively, an over-length piece of resin stock may be guided through the support members 75 from an outer end and rotated to allow passage through openings that are sized to be snug. As the rod material reaches the innermost support 76, its rotation causes it to be lightly gripped by the shallow internal threads 82, causing it to be firmly held in place. The fiber optic material may be allowed to protrude slightly from the inner end, after which both ends are cut, such as by shearing, to present smooth face surfaces.

A substantially identical structure and process may be used for insertion and retention of fiber optic rods 64 of the rear sight element 26.

Figure 17:
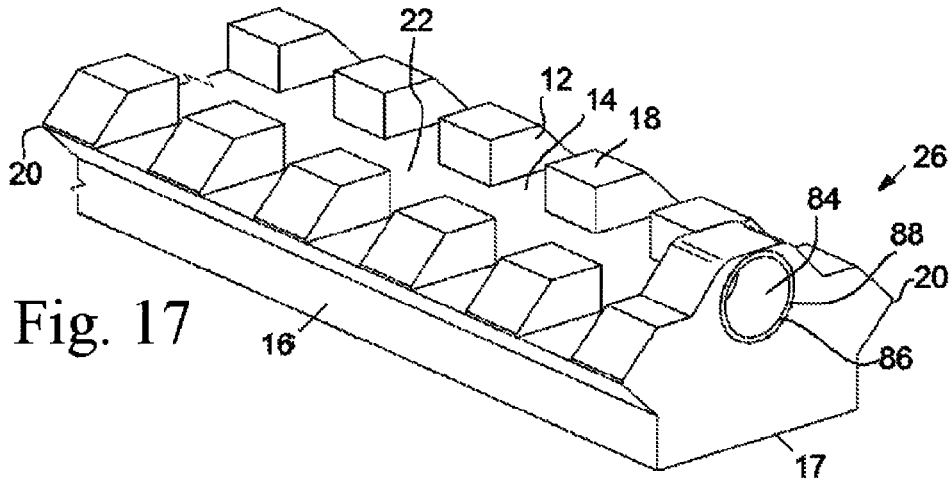
FIG. 17 is a fragmentary rear isometric view of an alternate rear sight element in the form of an aperture.

Referring now to FIG. 17, therein is shown an alternate rear sight element 26 in the form of an aperture 84. The aperture 84 may be round, oval, polygonal, or any desired shape. The aperture 84 provides laterally spaced apart visual markers, defined by an annular edge 86 as well as providing upper and lower visual markers for the rear sight element 26. If desired, the edge 86 of the aperture 84 maybe provided with a ring 88 of contrasting color or other visual enhancement.

As shown in FIG. 17, the rear sight element 26 may extend above the top platform 18 level of the mounting lugs 12, if desired. Such an extension beyond the profile of the Picatinny mounting rail is insignificant and does not inhibit substantially full functionally of the rail, particularly when only affecting one end.

The base 16 may have a bottom surface 17 that is flat or slightly concave in the transverse direction, and may include attachment openings 56 through which fasteners can be inserted for securing the rail 38 to, for example, the top of a shot gun receiver. The height 58 of the base 16 may be varied as desired to accommodate any particular application. Alternatively, a rail 10, 38, 60, 74 having integrated sight elements 24, 26 of the present invention may be attached to a firearm with a "saddle," which attaches to sides of the receiver or formed as part of another accessory device, such as a shotshell carrier, or the rails of barrel shroud at the 9-, 12-, or 3-o'clock (or intermediate angle) positions.

As used herein, "forward" or "front" refers to the muzzle or discharge end or direction of a firearm, distal from the user. "Rearward" or "rear" refers to end of the firearm proximal to the user and opposite the direction of a projectile discharge.

As used herein, "firearm" is intended to include a shotgun, rifle, handgun, air gun, airsoft, paintball marker, crossbow, bow, or any other device requiring sighting for aiming the discharge or launch of a projectile of any type.

As used herein, "tritium vial" means a sight marker insert of the type in which a thin glass vials whose inner surface are coated with a phosphor material is filled with tritium gas to produce fluorescent light by radioluminescence.

The illustrated embodiment was chosen and described to provide the best disclosure of the principles of the invention and its practical application to thereby enable one of ordinary skill in the art to utilize the invention in various embodiments and with various modifications as are suited to the particular use contemplated. All such modifications and variations are within the scope of the invention as determined by any allowed claims when interpreted in accordance with the breadth to which they are fairly, legally and equitably entitled. The drawings and preferred embodiments do not and are not intended to limit the ordinary meaning of the claims and their fair and broad interpretation in any way.

What is claimed is:

1. A firearm accessory mounting rail with an integrated back up sight system, comprising:

an elongated Picatinny rail having longitudinally spaced apart first and second ends and a transverse profile;

first and second sight elements longitudinally spaced apart, the first sight element having a visual marker substantially centrally laterally positioned and the second sight element having laterally spaced apart visual markers at least one of the sight elements being defined substantially completely within the transverse profile of the rail while in use;

a substantially centered longitudinal channel on an upper surface of the rail extending between the first and second sight elements;

whereby a firearm may be sighted by visually aligning the marker of the first sight element between the markers of the second sight element, such that, in use, visual alignment of the sight elements is at least partially through the longitudinal channel and substantially completely within the transverse profile of the rail.

2. The mounting rail of claim 1, wherein the first sight element is vertically adjustable.

3. The mounting rail of claim 1, wherein the second sight element is laterally adjustable.

4. The mounting rail of claim 1, wherein the markers are colored to contrast with adjacent portions of the rail.

5. The mounting rail of claim 4, wherein the marker of the first element is a color distinct from the markers of the second element.

6. The mounting rail of claim 1, wherein at least one of the visual markers is light emitting.

7. The mounting rail of claim 6, wherein the light emitting marker includes a light gathering fiber optic member.

8. The mounting rail of claim 7, wherein the markers of both the first and second sight elements include a light gathering fiber optic member and the marker of the first element is a color distinct from the markers of the second element.

9. The mounting rail of claim 6, wherein the light emitting marker includes a tritium vial.

10. The mounting rail of claim 1, wherein the second sight element includes an aperture.

11. The mounting rail of claim 1, wherein the channel is tapered in width, increasing toward the second sight element.

12. The mounting rail of claim 1, wherein the first sight element is positioned in the first end region of the rail.

13. The mounting rail of claim 1, wherein the second sight element is positioned in the second end region of the rail.

* * * * *